US005203177A

United States Patent [19]

Manz et al.

[11] Patent Number: 5,203,177

[45] Date of Patent: Apr. 20, 1993

[54] REFRIGERANT HANDLING SYSTEM WITH INLET REFRIGERANT LIQUID/VAPOR FLOW CONTROL

[75] Inventors: Kenneth W. Manz, Paulding; Christopher M. Powers; Gregg E. Laukhuf, both of Bryan, all of Ohio

[73] Assignee: SPX Corporation, Muskegon, Mich.

[21] Appl. No.: 797,360

[22] Filed: Nov. 25, 1991

[51] Int. Cl.[5] ..... F25D 21/00

[52] U.S. Cl. ..... 62/149; 62/292; 62/197; 62/218; 62/503

[58] Field of Search ..... 62/77, 85, 149, 197, 62/218, 292, 475, 503

[56] References Cited

U.S. PATENT DOCUMENTS

| | | | |
|---|---|---|---|
| 2,270,934 | 1/1942 | Dickieson, Jr. | 62/503 |
| 3,955,374 | 5/1976 | Zearfoss, Jr. | 62/197 |
| 4,261,178 | 4/1981 | Cain | 62/292 |
| 4,646,527 | 3/1987 | Taylor | 62/503 |
| 4,768,347 | 9/1988 | Manz et al. | 62/292 |
| 4,809,520 | 3/1989 | Manz et al. | 62/292 |
| 4,856,289 | 8/1989 | Lofland | 62/292 |
| 4,981,020 | 1/1991 | Scuderi | 62/292 |
| 5,005,369 | 4/1991 | Manz | 62/292 |
| 5,042,271 | 8/1991 | Manz | 62/292 |

*Primary Examiner*—John M. Sollecito
*Attorney, Agent, or Firm*—Barnes, Kisselle, Raisch, Choate, Whittemore & Hulbert

[57] ABSTRACT

A refrigerant recovery system includes a compressor and an evaporator connected to the compressor inlet for evaporating refrigerant passing therethrough to the compressor inlet from refrigerant equipment under service. A sensor is coupled to the system input for detecting presence of liquid phase refrigerant. A valve is connected to the compressor inlet in parallel with the evaporator for bypassing refrigerant from the evaporator to the compressor inlet when the sensor indicates that liquid refrigerant is absent at the system input. The liquid refrigerant sensor takes the form of an open canister between the system input and the evaporator, and a liquid level sensor coupled to the canister for sensing level of liquid refrigerant collected within the canister. A solenoid valve is connected in parallel with the evaporator, and is responsive to the liquid level sensor for opening the valve and bypassing the evaporator in the absence of liquid refrigerant within the canister. In this way, when input refrigerant is already in vapor phase, such refrigerant is bypassed to the compressor inlet, eliminating undesirable superheating of the refrigerant within the evaporator.

26 Claims, 2 Drawing Sheets

REFRIGERANT HANDLING SYSTEM WITH INLET REFRIGERANT LIQUID/VAPOR FLOW CONTROL

The present invention is directed to systems for handling refrigerant in either liquid, vapor or mixed liquid/vapor phase, and more particularly to systems for recovering refrigerant in liquid and/or vapor phase from refrigeration equipment such as air conditioning and heat pump equipment.

BACKGROUND AND OBJECTS OF THE INVENTION

Many scientists contend that release of halogen refrigerants into the atmosphere deleteriously affects the ozone layer that surrounds and protects the earth from ultraviolet solar radiation. Recent international discussions and treaties, coupled with related regulations and legislation , have renewed interest in devices for recovery and storage of used refrigerants from refrigeration equipment for later purification and reuse or for proper disposal. U.S. Pat. No. 4,261,178, assigned to the assignee hereof, discloses a refrigerant recovery system in which the inlet of a compressor is coupled through an evaporator and through a manual valve to the refrigeration equipment from which refrigerant is to be recovered. The compressor outlet is connected through a condenser to a refrigerant storage container. The condenser and evaporator are combined in a single assembly through which cooling air is circulated by a fan. Content of the storage container is monitored by a scale on which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration system and automatically terminating operation of the compressor motor.

U.S. Pat. Nos. 4,768,347 and 4,809,520, also signed to the assignee hereof, discloses a refrigerant recovery system that includes a compressor having an inlet coupled through an evaporator and through a solenoid valve to the refrigeration equipment from which refrigerant is to be withdrawn, and an outlet coupled through a condenser to a refrigerant storage container or tank. The refrigerant storage container is carried by a scale having a limit switch coupled to control electronics to prevent or terminate further refrigerant recovery when the container is full. The scale comprises a platform pivotally mounted by a hinge pin to a wheeled cart, which also carries the evaporator/condenser unit, compressor, control electronics, and associated valves and hoses.

Although the systems disclosed in the noted patents address and overcome problems theretofore extant in the art, further improvements remain desirable. For example, a problem remains relative to controlling inlet flow to the evaporator and compressor so as to maximize overall recovery speed and efficiency for either liquid, vapor or mixed liquid/vapor phase inlet refrigerant, while ensuring that refrigerant at the compressor is in vapor phase so as to prevent slugging at the compressor. It is also desirable to control the inlet refrigerant flow in such a manner as to minimize superheating of the refrigerant in the evaporator, which reduces efficiency of the handling system and the amount of refrigerant that can be pumped therethrough.

It is therefore a general object of the present invention to provide a refrigerant handling system, such as a refrigerant recovery system, that includes the capability of handling inlet refrigerant in either vapor phase, liquid phase or mixed liquid/vapor phase, that is adapted to optimize flow of refrigerant therethrough a function of inlet refrigerant phase, and that ensures that refrigerant at the compressor inlet is in vapor phase so as to prevent slugging and possible damage to the compressor. Another and related object of the present invention is to provide a refrigerant handling system of the described character that operates automatically without operator invention. A further object of the present invention is to provide a refrigerant handling system of the described character in which flow of refrigerant to the evaporator is optimized for enhanced heat exchange with the refrigerant condenser while substantially reducing or preventing superheating of the refrigerant.

SUMMARY OF THE INVENTION

A refrigerant handling system in accordance with the present invention includes a compressor and an evaporator connected to the compressor inlet for evaporating refrigerant from a refrigerant source passing therethrough to the compressor inlet. In accordance with a first aspect of the invention, a sensor is coupled to the system input for detecting presence of liquid phase refrigerant. A valve is connected to the compressor inlet in parallel with the evaporator for bypassing refrigerant from the evaporator to the compressor inlet when the sensor indicates that liquid refrigerant is absent at the system input. In one embodiment of the invention, the liquid refrigerant sensor takes the form of an open canister between the system input and the evaporator, and a liquid level sensor coupled to the canister for sensing level of liquid refrigerant collected within the canister. A solenoid valve is connected in parallel with the evaporator, and is responsive to the liquid level sensor for opening the valve and bypassing the evaporator in the absence of liquid refrigerant within the canister. In another embodiment of the invention, the sensor comprises a sight glass for operator observation of refrigerant phase passing to the evaporator, and a solenoid valve coupled to a manual switch for selectively bypassing the evaporator when only vapor phase refrigerant is observed at the sight glass. In this way, when input refrigerant is already in vapor phase, such refrigerant is bypassed to the compressor inlet, eliminating undesirable superheating of the refrigerant within the evaporator.

In accordance with a second aspect of the present invention, which may be used separately from or in combination with the first aspect of the invention discussed hereinabove, a condenser is connected to the compressor outlet in heat exchange relationship with the evaporator. The evaporator/condenser unit comprises a closed canister in which the condenser takes the form of a coil disposed within the canister at a lower portion of the canister volume. A liquid refrigerant level sensor is operatively coupled to the evaporator/condenser canister for detecting a level of liquid phase refrigerant in the evaporator section and covering or encompassing the condenser coils. The level sensor is connected to a solenoid valve at the evaporator inlet of the evaporator/condenser for admitting refrigerant to the internal canister volume so as to maintain level of refrigerant just covering the condenser coil. In this way, liquid refrigerant is maintained within the canister at a level for optimum heat exchange with the condenser coil. Most preferably, a second liquid refrigerant level sensor is positioned below the first sensor for detecting decrease of liquid refrigerant to a second lower level, and for automatically opening a second solenoid valve parallel of the first valve for increasing flow of refrigerant to the canister. In this way, if the input refrigerant is substantially in vapor phase, the flow of refrigerant vapor to the compressor inlet will be greatly increased. In a presently preferred implementation of the invention in a refrigerant recovery system, the compressor outlet is connected through the condenser to a refrigerant storage container, with the condenser functioning for at least partially condensing or liquefying refrigerant fed therethrough to the storage container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
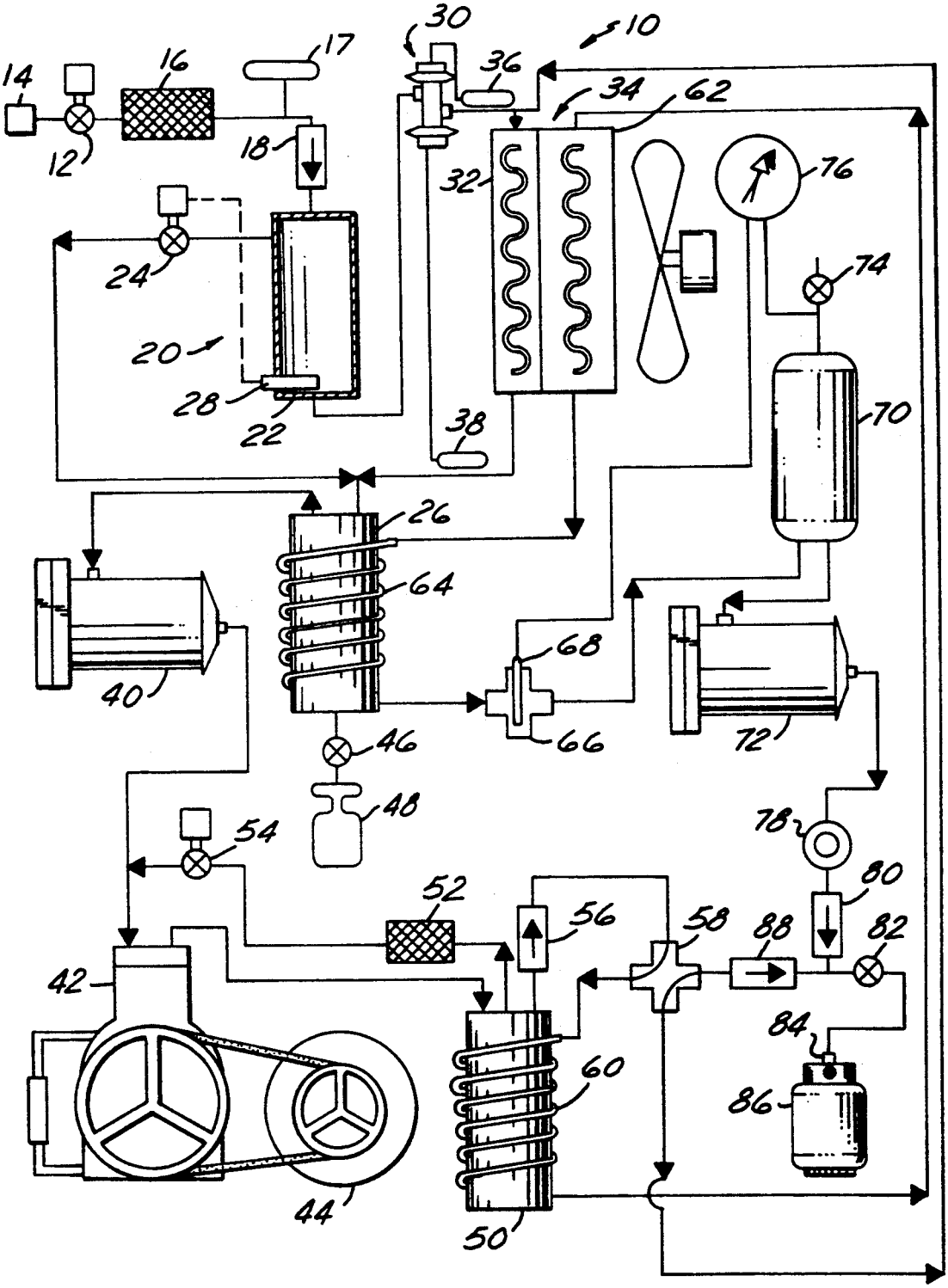
FIG. 1 is a schematic diagram of a refrigerant recovery system in accordance with one presently preferred embodiment of the invention.

FIG. 1 illustrates a refrigerant recovery system 10 in accordance with a presently preferred embodiment of the invention as comprising an input solenoid valve 12 coupled to a connector 14 for connection to equipment under service from which refrigerant is to be withdrawn. Refrigerant from valve 12 is fed through a filter 16 and a check valve 18 to an accumulator 20 for separating liquid phase refrigerant from vapor phase refrigerant. A pressure sensor 17 is connected between filter 16 and check valve 18. Accumulator 20 comprises a canister 22 having an open internal volume. Refrigerant from check valve 18 is fed into the upper portion of the canister volume, and an outlet port from the upper portion of the canister volume is connected through a solenoid valve 24 to an oil separator 26. A refrigerant liquid level sensor 28 of any suitable type is positioned within the lower portion of canister 22, and is operatively connected to solenoid valve 24. When liquid refrigerant is present at sensor 28, valve 24 is closed. On the other hand, when sensor 28 detects absence of liquid refrigerant within canister 22, valve 24 is opened.

A liquid refrigerant port at the lower portion of canister 22 is connected through a flow control valve 30 to the inlet of the evaporator section 32 of a combined evaporator/condenser unit 34. Control inputs to valve 30 are connected to refrigerant bulbs 36, 38 positioned at the inlet and outlet sides of evaporator 32 respectively. Structure and function of control valve 30 and bulbs 36, 38 are disclosed in detail in co-pending application Ser. No. 07/641,433 assigned to the assignee hereof, to which reference may be made for more detailed discussion. The outlet of evaporator section 32 is connected to the inlet of oil separator 26. Thus, when liquid phase input refrigerant is detected by sensor 28, valve 24 is closed, and the liquid refrigerant is preferentially fed through evaporator section 32 to oil separator 26. However, when liquid phase refrigerant is absent at the system input, sensor 28 opens valve 24, which thus bypasses evaporator 32 and feeds vapor phase refrigerant directly to oil separator 26.

Refrigerant is fed from oil separator 26 through a filter/dryer unit 40 for removing water vapor, acid and other contaminants from refrigerant passing therethrough, to the inlet of a compressor 42 driven by a motor 44. Oil collected in separator 26 is selectively drained by a valve 46 to a catch bottle 48. The outlet of compressor 42 is connected to a compressor oil separator 50, from which return oil is fed through a filter 52 and a solenoid valve 54 to the compressor inlet. The refrigerant outlet of separator 50 is connected through a check valve 56 to a manual valve 58, which may be placed in the configuration as shown for normal recovery operation, or in an opposing configuration for clearing refrigerant from the system components. Valve 58 is connected through a coil 60 that surrounds oil separator 50 in heat exchange relation with the separator wall and refrigerant within the separator. The general structure and function of separator 50 with coil 60 are disclosed in U.S. Pat. No. 5,042,271, to which reference may be made for further details. The general structure and function of valve 58 is disclosed in co-pending application Ser. No. 07/681,365 assigned to the assignee hereof, to which reference may be made for further details.

The outlet end of coil 60 is connected through the condenser section 62 of evaporator/condenser unit 34, and thence through a coil 64 that surrounds oil separator 26. The outlet end of coil 64 is connected through a chamber 66 in heat exchange relationship with refrigerant captured within a bulb 68. The outlet side of chamber 66 is connected through an air purge tank 70 to a liquid refrigerant filter/dryer 72 for removing any water, acid or particular contaminants that may remain within the refrigerant. The purge port of tank 70 is connected to a manual valve 74, and to one input of a double-needle gage 76. The second input of gage 76 is connected to bulb 68. Gage 76 thus reads a pressure differential between air captured within operator may selectively purge air from within tank 70 by operation of valve 74. The structure and function of such air purge system are disclosed in greater detail U.S. Pat. No. 5,005,369 and U.S. application Ser. No. 07/576,952 assigned to the assignee hereof, to which reference may be made for further detail.

The outlet side of filter 72 is connected through a moisture indicator 78, a check valve 80 and a manual valve 82 to a connector 84 for connection to the vapor port of a liquid refrigerant storage container 86. Valve 58 is also connected to valve 82 through a check valve 88, and valve 58 is connected to the inlet of evaporator 32 in parallel with flow control valve 30 for selectively clearing refrigerant from coil 60, condenser 62 and coil 64 as described in above-noted U.S. application Ser. No. 07/681,365.

In operation, connecter 14 is coupled to refrigeration equipment from which refrigerant is to be recovered, and connector 84 is coupled to storage container 86 as shown. Compressor motor 44 and compressor 42 are energized, and valve 12 is opened to initiate a refrigerant recovery operation. If incoming refrigerant to accumulator 20 is in liquid or mixed liquid/vapor phase, presence of liquid in the accumulator is detected by sensor 28 and valve 24 is closed. Such liquid refrigerant is fed through valve 30, evaporator 32, oil separator 26 and filter 40 to compressor 42, and thence from the compressor through oil separator 50, condenser 62, coil 64, air purge tank 70, filter 72, moisture indicator 78 and valve 82 to tank 86. On the other hand, if the input refrigerant is entirely in vapor phase or switches from liquid phase to vapor phase, sensor 28 opens valve 24 as soon as all liquid phase refrigerant has been withdrawn from accumulator 20, so that incoming vapor phase refrigerant is fed directly to oil separator 26 and compressor 42 bypassing evaporator 32. In this way, not only is the rate of refrigerant recovery greatly enhanced, but superheating of input refrigerant already in vapor phase is avoided. When refrigerant has been fully recovered from the equipment coupled to connector 14, pressure sensor 17 functions to close valve 12 and/or remover energy from compressor motor 44.

Figure 2:
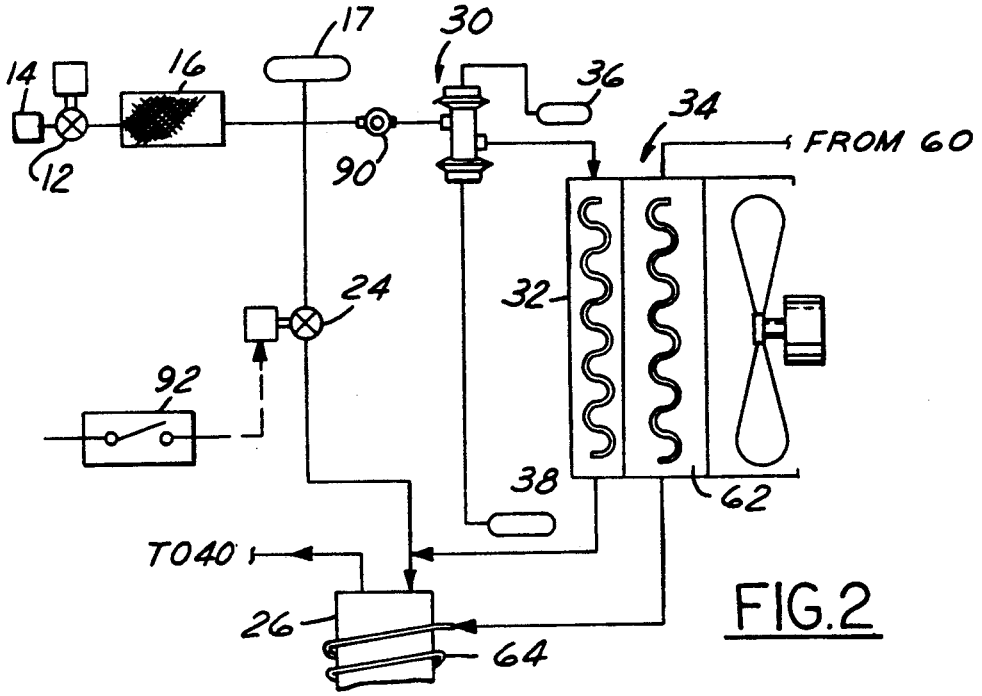
FIG. 2 is a fragmentary schematic diagram of a portion of the system illustrated in FIG. 1 showing a modified embodiment of the invention.
Figure 3:
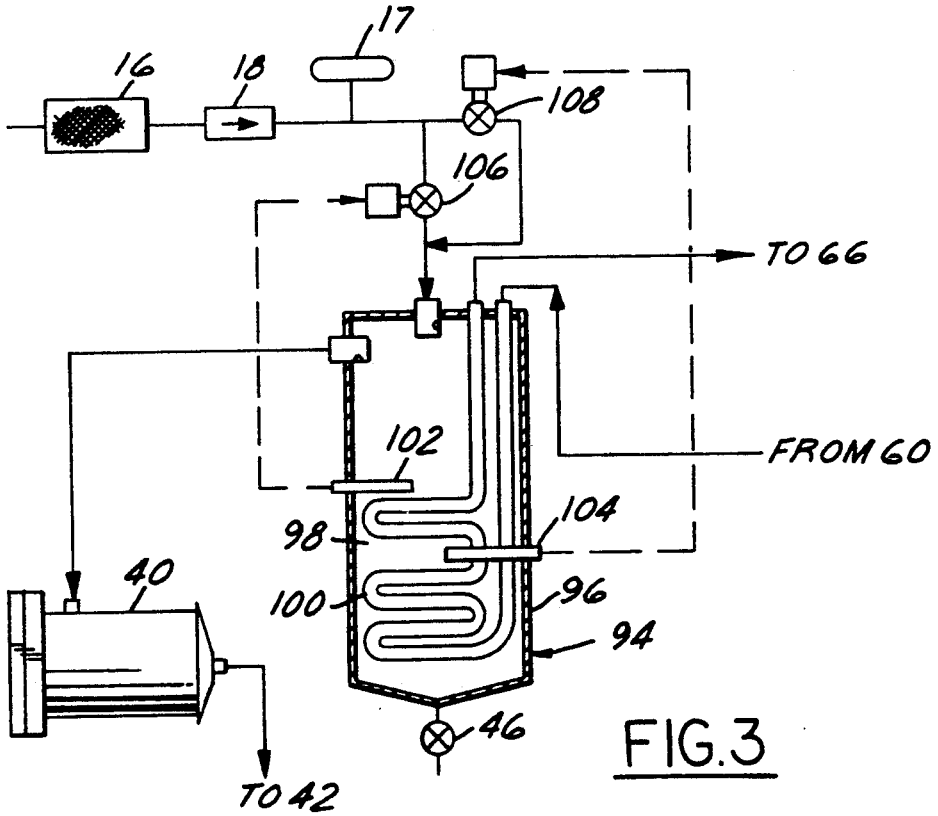
FIG. 3 is a fragmentary schematic diagram of a portion of the system illustrated in FIG. 1 showing a second modified embodiment of the invention.

FIGS. 2 and 3 illustrate modified embodiments of the invention, in which reference numerals identical to those employed in FIG. 1 indicate correspondingly identical parts. In FIG. 2, vapor/liquid separation accumulator 20 of FIG. 1 is replaced by a sight glass 90 connected between filter 16 and control valve 30, through which an operator may observe the phase or phases of input refrigerant. Solenoid valve 24 is connected between sight glass 90 and the inlet of oil separator 26, and is controlled by a manual switch 92 connected to a suitable source of electrical power (not shown). When the operator observes at sight glass 90 that input refrigerant is in liquid or mixed liquid/vapor phase, switch 92 and valve 24 remain open, and all input refrigerant is fed to evaporator 32. On the other hand, when the operator does not observe liquid phase refrigerant at sight glass 90, switch 92 is closed to energize valve 24 and thereby bypass refrigerant from evaporator 32.

In the embodiment of FIG. 3, evaporator/condenser unit 34 and oil separator 26 (FIGS. 1 and 2) are replaced by a combined heat-exchange/oil-separator unit 94. Unit 94 comprises a closed generally cylindrical canister 96 having an open internal volume 98 and a condenser coil 100 disposed within the lower portion of volume 98. A pair of liquid ports and a pair of vapor ports are provided at the upper end of canister 94. To the extent thus far described, heat-exchange/oil-separator unit is essentially the same as that disclosed in U.S. Pat. Nos. 4,768,347 and 4,809,520 noted above. The liquid ports of unit 94 are connected to coil 60 of oil separator 50 and chamber 66 (FIG. 1) respectively. One vapor port of unit 94 is connected to the inlet side of filter 40.

A first liquid level sensor 102 is positioned within canister 96 closely adjacent to but just above condenser coil 100 for sensing when refrigerant just covers the condenser coil. A second liquid refrigerant level sensor 104 is positioned beneath sensor 102 for sensing a lower level of liquid refrigerant within canister 96. Sensor 102 is operatively coupled to a first solenoid valve 106 for feeding refrigerant to the input port of canister 96. Sensor 104 is operatively coupled to a second solenoid valve 108 connected in parallel with valve 106. Valve 106 has a relatively restricted flow passage for selectively admitting liquid phase refrigerant, or mixed liquid/vapor phase refrigerant, to canister 96 under control of sensor 102. When sensor 102 detects that liquid refrigerant is below the level of the sensor, sensor 102 automatically opens valve 106 to admit additional liquid refrigerant to bring the refrigerant level backup to the position of the sensor, at which point valve 106 is closed.

On the other hand, valve 108 is configured to have a relatively large refrigerant flow passage for admitting refrigerant in vapor phase under control of sensor 104. That is, when the level of refrigerant within volume 98 falls below the level of sensor 104, absence of input liquid phase refrigerant is inferred, and sensor 104 opens valve 108 for high-volume admission of refrigerant in vapor phase. Vapor phase refrigerant, either as admitted through valves 106, 108 or as evaporated from liquid phase refrigerant within the lower portion of canister 96, exits the canister through the second vapor port, and is fed to filter 40 and thence to compressor 42 (FIG. 1) as previously described. Thus, input refrigerant flow is controlled by sensors 102, 104 and valves 106, 108 as a function of refrigerant phase to maximize the refrigerant throughput without over flowing the heat exchange unit.

We claim:

1. A refrigerant handling system that includes a compressor having an inlet and an outlet, means coupled to said compressor inlet for evaporating refrigerant passing therethrough, input means for connecting said evaporating means to a source of refrigerant, means coupled to said input means for determining presence of liquid refrigerant at said input means, and means connected between said input means and said compressor inlet in parallel with said evaporating means for bypassing refrigerant from said evaporating means to said compressor inlet when liquid refrigerant is absent at said input means, said means for determining presence of liquid refrigerant at said input means comprising refrigerant accumulation means connected between said input means and said evaporating means having an open internal volume, means coupled to said volume for detecting level of liquid refrigerant therein, and means responsive to said level-detecting means for indicating absence of liquid refrigerant within said volume.

2. The system set forth in claim 1 wherein said refrigerant bypassing means comprises a refrigerant valve and means for opening said valve in the absence of liquid refrigerant at said inlet means.

3. The system set forth in claim 1 wherein said bypassing means comprises a solenoid valve, and wherein said means responsive to said level-detecting means comprises means for opening said solenoid valve in the absence of liquid refrigerant in said volume.

4. A refrigerant handling system that includes a compressor having an inlet and an outlet, means coupled to said compressor inlet for evaporating refrigerant passing therethrough, input means for connecting said evaporating means to a source of refrigerant, means coupled to said input means for determining presence of liquid refrigerant at said input means, and means connected between said input means and said compressor inlet in parallel with said evaporating means for bypassing refrigerant from said evaporating means to said compressor inlet when liquid refrigerant is absent at said input means, said refrigerant bypassing means comprising a refrigerant valve and means for opening said valve in the absence of liquid refrigerant at said input means.

5. The system set forth in claim 4 wherein said means for determining presence of liquid refrigerant at said input means comprises refrigerant accumulation means connected between said input means and said evaporating means having an open internal volume, means coupled to said volume for detecting level of liquid refrigerant therein, and means responsive to said level-detecting means for indicating absence of liquid refrigerant within said volume.

6. The system set forth in claim 5 wherein said valve comprises a solenoid valve, and wherein said means responsive to said level-detecting means comprises means for opening said solenoid valve in the absence of liquid refrigerant in said volume.

7. The system set forth in claim 4 wherein said means for determining presence of liquid refrigerant at said input means comprises a sight glass connected between said input means and said evaporating means for visual observation of liquid refrigerant flowing to said evaporating means.

8. The system set forth in claim 7 wherein said means for opening said valve comprises means for manually opening said valve in the absence of liquid refrigerant at said sight glass.

9. The system set forth in claim 4 further comprising condenser means coupled to said compressor outlet in heat exchange relationship with said evaporating means.

10. The system set forth in claim 9 further comprising a refrigerant storage container connected to receive refrigerant from said condenser means.

11. A refrigerant recovery system that includes a refrigerant compressor having an inlet and an outlet, input means for connection to refrigeration equipment from which refrigerant is to be recovered, means connected between said input means and said compressor inlet for evaporating refrigerant passing therethrough, a refrigerant storage container, condenser means coupled between said compressor outlet and said storage container for at least partially condensing refrigerant fed to said storage container, means coupled to said input means for detecting absence of liquid refrigerant at said input means, and means coupled to said absence-detecting means for selectively controlling flow of refrigerant from said input means to said compressor inlet.

12. The system set forth in claim 11 wherein said absence-detecting means comprises means having an open internal volume connected to said input means, means coupled to said volume for detecting level of liquid refrigerant therewithin, and means for indicating absence of liquid at said input means as an function of liquid refrigerant level in said volume.

13. The system set forth in claim 12 wherein said means for selectively controlling flow of refrigerant comprises a solenoid valve connected between said input means and said compressor inlet, and means operatively coupling said solenoid valve to said level-detecting means for opening said valve in the absence of liquid refrigerant at said input means.

14. The system set forth in claim 13 wherein said solenoid valve is operatively connected between said input means and said compressor inlet, and is responsive to absence of liquid refrigerant at said level-detecting means for feeding refrigerant from said input means to said compressor inlet bypassing said evaporator means.

15. The system set forth in claim 13 wherein said evaporating means and said means having an open internal volume are combined is a unitary construction.

16. The system set forth in claim 15 wherein said condenser means comprises a condenser coil disposed in heat exchange relationship with refrigerant in said volume.

17. The system set forth in claim 13 wherein said condenser means is disposed in heat exchanger relationship with said evaporating means.

18. The system set forth in claim 11 wherein said means for selectively controlling refrigerant flow comprises a refrigerant valve and means for opening said valve in the absence of liquid refrigerant at said input means.

19. The system set forth in claim 18 wherein said means for detecting absence of liquid refrigerant at said input means comprises a sight glass connected between said input means and said evaporating means for visual observation of liquid refrigerant flowing to said evaporating means.

20. The system set forth in claim 19 wherein said means for opening said valve comprises means for manually opening said valve in the absence of liquid refrigerant at said sight glass.

21. A refrigerant handling system that includes a compressor having an inlet and an outlet, input means for connection to a source of refrigerant, refrigerant evaporator means including means having an open internal volume coupled to said compressor inlet, refrigerant condenser means including a refrigerant coil disposed within a lower portion of said volume, first liquid refrigerant level detection means coupled to said volume for detecting a level of refrigerant at an upper end of said coil covering said coil, and flow control means disposed between said input means and said volume and responsive to said level-detecting means for restricting flow of refrigerant to said volume while maintaining level of liquid refrigerant covering said coil for optimum heat exchange with said coil.

22. The system set forth in claim 21 wherein said flow control means comprises a control valve for admitting refrigerant to said volume when level of liquid refrigerant in said volume is below said first level-detecting means and termination flow of refrigerant to said volume when level of liquid refrigerant is at said first level-detection means.

23. The system set forth in claim 22 wherein said valve comprises a solenoid valve responsive to said first level detecting means for automatically admitting and terminating flow of refrigerant to said volume.

24. The system set forth in claim 22 wherein said flow control means further comprises second liquid refrigerant level detection means coupled to said volume for detecting a level of liquid refrigerant lower then said first level detection means, and means responsive to said second level detection means for increasing flow of refrigerant to said volume.

25. The system set forth in claim 24 wherein said means responsive to said second level detection means comprises a second flow control valve connected in parallel with said first flow control valve.

26. The system set forth in claim 22 wherein said first level detector means comprises a liquid refrigerant sensor positioned when said volume adjacent to said upper end of said coil.

* * * * *